US011299181B2

(12) United States Patent
Chien et al.

(10) Patent No.: US 11,299,181 B2
(45) Date of Patent: Apr. 12, 2022

(54) PLATFORM DOOR SYSTEM AND METHOD FOR CONTROLLING THE SAME

(71) Applicants: Kaohsiung Rapid Transit Corporation, Kaohsiung (TW); Industrial Technology Research Institute, Hsinchu (TW)

(72) Inventors: Shih-Hsiang Chien, Wujie Township (TW); Wen-Tsuen Chen, Hsinchu (TW); Hsin-I Chiang, Kaohsiung (TW); Chien-Liang Liu, Kaohsiung (TW)

(73) Assignees: KAOHSIUNG RAPID TRANSIT CORPORATION, Kaoshiung (TW); INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 684 days.

(21) Appl. No.: 16/233,999

(22) Filed: Dec. 27, 2018

(65) Prior Publication Data

US 2020/0148233 A1 May 14, 2020

(30) Foreign Application Priority Data

Nov. 8, 2018 (TW) ..... 107139720

(51) Int. Cl.
*B61B 1/02* (2006.01)
*E05F 15/73* (2015.01)

(52) U.S. Cl.
CPC ..... *B61B 1/02* (2013.01); *E05F 15/73* (2015.01); *E05F 2015/767* (2015.01); *E05Y 2900/51* (2013.01)

(58) Field of Classification Search
CPC ..... B61B 1/02; E05F 15/73; E05F 2015/767; E05Y 2900/51
See application file for complete search history.

(56) References Cited

U.S. PATENT DOCUMENTS 7,677,178 B2 * 3/2010 Ellmann ..... B61B 1/02 104/28
8,109,214 B2 * 2/2012 Bradley ..... B61B 1/02 104/28

(Continued)

FOREIGN PATENT DOCUMENTS

CN 1380211 A 11/2002
CN 101105096 1/2008

(Continued)

OTHER PUBLICATIONS

Wang et al., A Study on Structural Deformation of Platform Screen Foor Based Artificial Neural Network, 2015 International Conference on Fluid Power and Mechatronics, Aug. 5-7, 2015, 4 pages, Harbin, China.

(Continued)

*Primary Examiner* — Jason C Smith
(74) *Attorney, Agent, or Firm* — Muncy, Geissler, Olds & Lowe, P.C.

(57) ABSTRACT

A platform door system is disclosed. The platform door system has: a platform data transmitting element positioned on a platform for transmitting a platform signal; a vehicle information integrating element, positioned on a vehicle adjacent to the platform, for receiving the platform signal and a vehicle signal corresponding to a door opening or closing status of the vehicle door from the vehicle, and for transmitting a platform-vehicle integration signal; and a platform door controlling element, positioned on the platform, for receiving the platform-vehicle integration signal and for opening or closing a platform door in response to the platform-vehicle integration signal to correspond to the opening-or-closing status of the vehicle door.

11 Claims, 3 Drawing Sheets

(56) References Cited

U.S. PATENT DOCUMENTS

| | | | | |
|---|---|---|---|---|
| 8,154,400 | B2 * | 4/2012 | Engel | B60L 13/00 340/538 |
| 8,405,937 | B2 * | 3/2013 | Liesenberg | B61B 1/02 361/1 |
| 9,884,635 | B2 * | 2/2018 | Miyajima | E05F 15/70 |
| 10,449,982 | B2 * | 10/2019 | Kashima | B61L 23/041 |
| 10,919,544 | B2 * | 2/2021 | Marco | B61L 15/0027 |
| 2018/0118225 | A1 * | 5/2018 | Marco | B61B 1/02 |
| 2020/0148233 | A1 * | 5/2020 | Chien | B61B 1/02 |
| 2021/0253137 | A1 * | 8/2021 | Klim | B61B 13/122 |

FOREIGN PATENT DOCUMENTS

| | | | | |
|---|---|---|---|---|
| CN | 101244724 | | | 8/2008 |
| CN | 103895655 | A | | 7/2014 |
| CN | 104661889 | B | | 10/2017 |
| EP | 2708432 | B1 | | 7/2015 |
| EP | 3124350 | A1 | | 2/2017 |
| JP | 2000071975 | A | | 3/2000 |
| JP | 2003300462 | A | | 10/2003 |
| JP | 2003327123 | | | 11/2003 |
| JP | 2004291742 | A | | 10/2004 |
| JP | 2006264475 | A | | 10/2006 |
| JP | 2007203752 | A | | 8/2007 |
| JP | 2011020657 | A | | 2/2011 |
| JP | 2011213334 | A | * | 10/2011 |
| JP | 2011213334 | A | | 10/2011 |
| JP | 2012245850 | | | 12/2012 |
| SG | 10201407937 | | | 6/2016 |
| TW | 201410525 | A | | 3/2014 |
| WO | WO 2018179781 | | | 10/2018 |

OTHER PUBLICATIONS

Lee et al., The effect of platform screen door (PSD) for fine particles at subway train in Seoul, Korea, ICROS-SICE International Joint Conference 2009, Aug. 18-21, 2009, 4 pages, Fukuoka, Japan.

Min et al., Study on PSD System Control Strategy for Safety, 2012 3rd International Conference on System Science, Engineering Design and Manufacturing Informatization, 2012, 6 pages.

Zhu et al., Study of Remote Monitoring System of Working States of Metro Door system, Proceedings of 2016 IEEE International Conference on Mechatronics and Automation, Aug. 7-10, 6 pages, Harbin, China.

Huang & Chen, Design of DC Operating Power for Metro Platform Screen Doors, 2010 International Conference on Intelligent System Design and Engineering Application, 2010, 6 pages.

Yang & Wang, Computation Simulation on Aerodynamic Characteristic of PSD in Subway Platform, 2009 International Conference on Computer Engineering and Technology, 2009, 4 pages.

Intellectual Property Office of the Republic of China, Office Action, dated Mar. 15, 2019.

* cited by examiner

PLATFORM DOOR SYSTEM AND METHOD FOR CONTROLLING THE SAME

This application claims the benefit of Taiwan application Serial No. 107139720, filed Nov. 8, 2018, the disclosure of which is incorporated by reference herein in its entirety.

TECHNICAL FIELD

The disclosure relates in general to a vehicle transportation system and a method for controlling the same, and particularly relates to a platform door system and a method for controlling the same.

BACKGROUND

Vehicle transportation system, such as railway transportation system, has advantages in capacity and reliability and has been the mainstream of public transportation. Platform door system is used to separate the passenger area on the platform from the adjacent vehicle driving area, in case passengers fall onto railway track before the vehicle has arrived.

Take the railway transportation system as an example, since this kind of system needs to take the opening-or-closing of the doors of the vehicle in to consideration, in operation, a complicated communication and control between the vehicle and the signalling system is a must. The best way therefore is to construct the power system, mechanical and electrical equipment, signalling system, and the communication system at the same time. If one or more systems are built later, there would be an integration issue, and a lot of royalties need to be paid to the signalling system supplier. In addition, as new types of vehicle keep launching, software and hardware of the platform door system needs to be changed frequently along with the renewal of the vehicle.

SUMMARY

According to one embodiment, a platform door system is disclosed. The platform door system comprises: a platform data transmitting element, a vehicle information integrating element, and a platform door controlling element. The platform data transmitting element is positioned on a platform for transmitting a platform signal. The vehicle information integrating element is positioned on a vehicle stopping at the platform, used for receiving the platform signal and a vehicle signal from the vehicle, and transmitting a platform-vehicle integration signal in accordance with the platform signal and the vehicle signal, wherein the vehicle signal corresponds to an opening-or-closing status of a vehicle door of the vehicle. The platform door controlling element is positioned on the platform, used for receiving the platform-vehicle integration signal, and opening or closing a platform door in response to the platform-vehicle integration signal to correspond to the opening-or-closing status of the vehicle door.

According to another embodiment, a control method for controlling a platform door system is disclosed. The control method comprises the following steps. First, providing a platform data transmitting element on a platform for transmitting a platform signal; providing a vehicle information integrating element on a vehicle stopping at the platform for receiving the platform signal and a vehicle signal from the vehicle, and for transmitting a platform-vehicle integration signal in accordance with the platform signal and the vehicle signal, wherein the vehicle signal corresponds to an opening-or-closing status of a vehicle door of the vehicle; and providing a platform door controlling element on the platform for receiving the platform-vehicle integration signal, and for opening or closing a platform door in response to the platform-vehicle integration signal to correspond to the opening-or-closing status of the vehicle door.

In accordance with the above embodiments, a platform door system and a method for controlling the same are disclosed. Through the wireless communication among the platform data transmitting element and the platform door controlling element positioned on the platform and the vehicle information integrating element positioned on the vehicle, information, which comprises if the vehicle stops and the opening or closing status of the vehicle door, and other vehicle relevant data, are exchanged. The platform signal is provided by the platform data transmitting element, and the vehicle information integrating element integrates the vehicle signal corresponding to the opening-or-closing status of the vehicle door from the vehicle and the platform signal from the platform to produce the platform-vehicle integration signal to be transmitted to the platform door controlling element. The platform door controlling element opens or closes the platform door in response to the platform-vehicle integration signal to correspond to the opening or closing status of the vehicle door.

At the same time, the vehicle door detecting element, positioned on the platform, is used to be a backup plan for individually detecting the opening or closing status of the vehicle door and transmitting the detected vehicle door opening-or-closing signal to the platform door controlling element. When the mutual communication between the platform and the vehicle fails, the platform door controlling element still can open or close the platform door, in accordance with the vehicle door opening-or-closing signal transmitted by the vehicle door detecting element, even if the platform door controlling element does not receive the platform-vehicle integration signal.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

Figure 1:
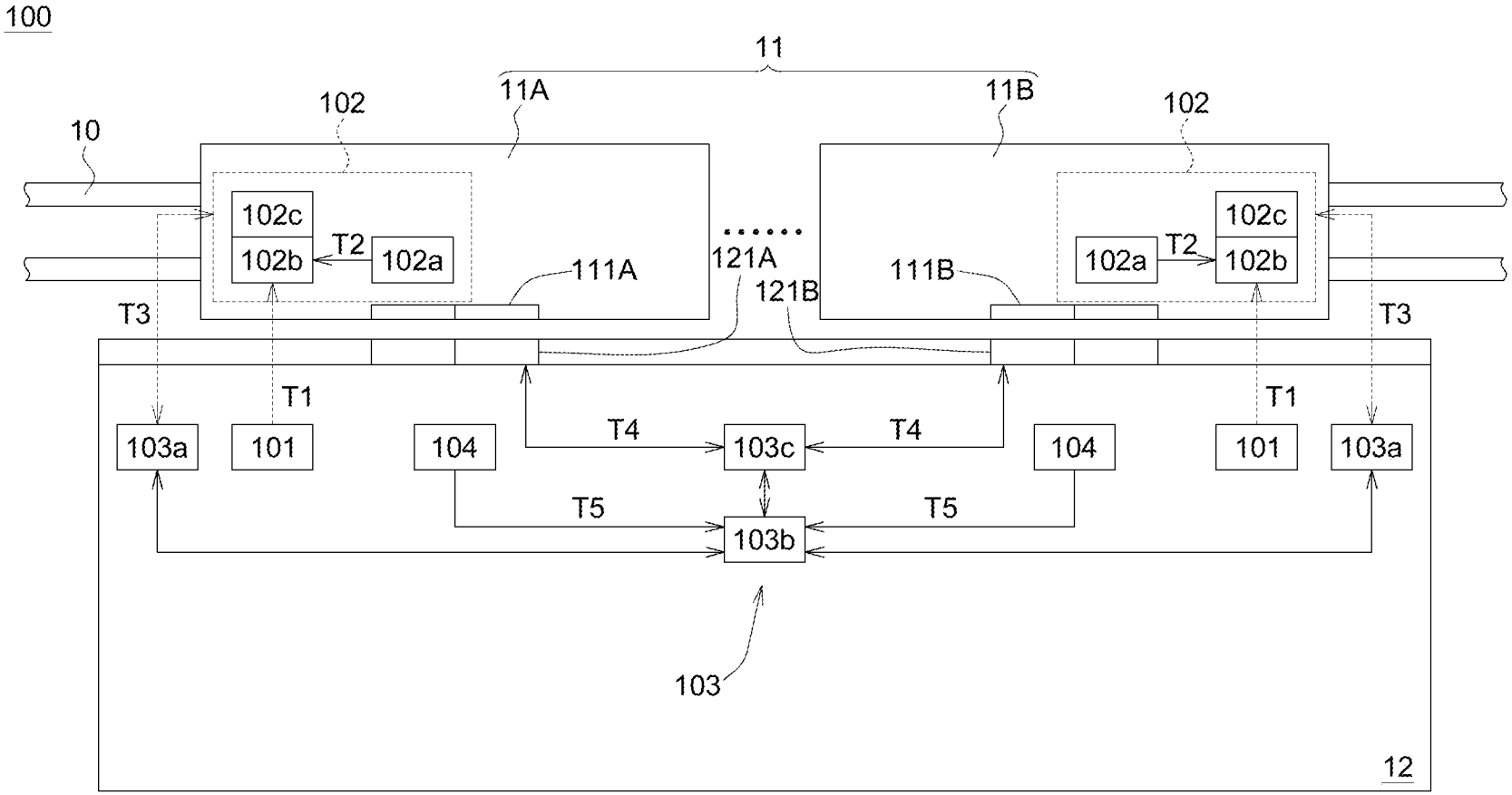
FIG. 1 illustrates a simplified block diagram of a platform door system 100 according to one embodiment.

In the following detailed description, for purposes of explanation, numerous specific details are set forth in order to provide a thorough understanding of the disclosed embodiments.

In the following detailed description, for purposes of explanation, numerous specific details are set forth in order to provide a thorough understanding of the disclosed embodiments. Although the present disclosure does not illustrate all possible embodiments, other embodiments not disclosed in the present disclosure are still applicable. Moreover, the dimension scales used in the accompanying drawings are not based on actual proportion of the product. Therefore, the specification and drawings are used for explaining and describing the embodiments only, but not used for limiting the scope of protection of the present disclosure. Furthermore, in the drawings of the embodiments, some elements are omitted so that some features can be clearly illustrated. Designations common to the accompanying drawings and embodiments are used to indicate identical or similar elements.

Please refer to FIG. 1. FIG. 1 illustrates a simplified block diagram of a platform door system 100 according to one embodiment. In some embodiments according to the present disclosure, the platform door system 100 may be a stopping facility and system applied to the railway transportation system, or may be a stopping facility and system applied to a roadway transportation system. In the embodiment shown in FIG. 1, the platform door system 100 is a stopping facility and system in the railway transportation system. The platform door system 100 comprises a vehicle 11 movable on the track 10, and a platform 12 adjacent to the track 10 for the vehicle 11 to stop at. Each vehicle 11 has at least one car (for example, a car 11A or car 11B), and each car 11A or 11B has as least one vehicle door (for example, a vehicle door 111A or vehicle door 111B).

When the vehicle 11 stops at the platform 12, the vehicle doors 111A and 111B of the vehicle 11 are open for loading/unloading cargos or for passengers boarding/deboarding; after the getting on/off is done, the vehicle doors 111A and 111B of the vehicle 11 are closed and the vehicle 11 will depart from the platform 12. The platform 12 comprises at least one platform door (for example, a platform door 121A or 121B) corresponding to the vehicle door 111A (or 111B) for opening or closing in response to the opening or closing of the vehicle door 111A (or 111B) of the vehicle 11, such that the passenger/cargo area on the platform is kept from the adjacent platform 12 to prevent the passengers/cargos falling onto the track 10 before the vehicle 11 has arrived the platform 12. In the embodiment, for example, each car 11A (or 11B) has a vehicle door 111A (or 111B), the platform 12 has many platform doors (e.g. the platform doors 121A and 121B), and each platform door 121A (or 121B) exactly corresponds/aligned with the vehicle door 111A (or 111B) of the car 11A (or 11B).

It is noted that in FIG. 1, the vehicle 11 only comprises to cars 11A and 11B; however, in other embodiments, the vehicle 11 may comprise a single car (the car 11A or 11B) or more cars, and each car 11A (or 11B) of the vehicle 11 may comprise many vehicle doors (not shown). For easy to explain, the platform system 100 described as follows has one vehicle door 111A of one car 11A in the vehicle 11 and one platform door 121A corresponding to the one vehicle door 111A.

Besides, the platform door system 100 is not limited to the railway transportation system. The platform system 100 described herein may be applied to any transportation which has a fixed route and carry cargos or passengers. In other embodiments, for example, the platform door system 100 may be applied to a stopping facility and system in a rubber-tire transportation system. The platform 12 may be a facility or building adjacent to the lane (or track) where the vehicle moves, and for the vehicle 11 to stop at and for the passengers or cargos to get on/off the vehicle 11.

The platform door system 100 may at least comprise a platform data transmitting element 101, a vehicle information integrating element 102, a platform door controlling element 103, and a vehicle door detecting element 104. The platform data transmitting element 101 is positioned on the platform 12 for transmitting a platform signal T1 relevant to the platform 12. In some embodiments of the present disclosure, for example, the platform data transmitting element 101 may be a signal transmitting device, such as a radio frequency identification (RFID) tag, a radio transmitter, a light transmitter, a sound wave transmitter, or a combination thereof. The platform signal T1 may comprise Identity Code (ID code) of the platform 12, such as the number of the platform 12.

In the embodiment, the platform data transmitting element 11 may be a radio frequency tag. When the vehicle 11 stops at the platform 12 and the vehicle door 111A is open or closed, a reader (not shown) positioned at a specific location in the vehicle door 111A will transmit a specific frequency of signal through an antenna; when the vehicle door 111A moves and make the RFID tag being into the working area of the antenna in the reader to induce current, the RFID tag gains energy and get activated to transmit a specific frequency of radio wave such that a transponder is driven to transform the ID code of the platform 12 (i.e. the ID code of the platform door 121A) into a wireless signal and transmit that signal. For example, when the vehicle 11 stops, the RDIF tag (platform data transmitting element 101) is within the working area of the antenna of the reader such that an electromagnetic induction is occurred and a RF signal (the platform signal T1) is transmitted.

The vehicle information integrating element 102 is positioned on the vehicle 11 for receiving the platform signal T1 and for integrating the platform signal T1 and the vehicle signal T2 to produce and transmit a platform-vehicle integration signal T3. The vehicle signal T2 is used to determine the information concerning an opening-or-closing status of the vehicle 11. In some embodiments of the present disclosure, the vehicle information integrating element 102 may be a control logic built in an operation system of the vehicle 11; however, in other embodiments, the vehicle information integrating element 102 may be a data processor individually set in the vehicle 11. The vehicle information integrating element 102 may comprise a vehicle information providing element 102*a*, a first wireless receiving element 102*b*, and a wireless transmitting element 102*c*. The vehicle information providing element 102 is used to provide the vehicle signal T2 relevant to the operation of the vehicle 11, the first wireless receiving element 102*b* is used to receive the platform signal T1, and the wireless transmitting element 102 is used to transmit the platform-vehicle integration signal T3 produced by the vehicle information integrating element 102.

In the embodiment, the vehicle information providing element 102*a* may comprise a detecting device for detecting the current operation status of the vehicle 11, such as a vehicle door opening/closing detector for detecting the opening/closing status of the vehicle door 111A, a Global Positioning System (GPS) for detecting the position of the vehicle 11, an image detector for detecting the contents of the cargo carried by the vehicle 11, a counter for detecting the numbers of the passengers or cargos carried by the vehicle 11, or a combination thereof. The vehicle information providing element 102*a* is used to provide the vehicle signal T2 relevant to the information regarding actual operation of the vehicle 11 in terms of the opening or closing status of the vehicle door 111A, the position, the contents of the cargos, etc. of the vehicle 11. The first wireless receiving element 102*b* is used for receiving the platform signal T1 and may be any kind of wireless signal receiver in response to the signal transmitted by the platform data transmitting element 101. The first wireless receiving element 102*b* may be a reader for receiving the RF signal.

The platform signal T1 received by the first wireless receiving element 102*b* and the vehicle signal T2 provided by the vehicle information providing element 102*a* may be transmitted with wire or wirelessly to the vehicle information integrating element 102 to integrating information. The wireless transmitting element 102*c* may be any kind of wireless transmitter for transforming the platform-vehicle integration signal T3 (which at least comprises the ID code of the stopped vehicle 11/vehicle door 111A, the ID code of the platform 12/platform door 121A, and the opening or closing status of the current vehicle door 111A of the vehicle 11) into an wireless signal and transmitting the signal out.

The platform door controlling element 103, positioned on the platform 12, is used to receive the platform-vehicle integration signal T3 and open or close the platform door 121A in response to the platform-vehicle integration signal T3 to correspond to the opening or closing of the vehicle door 111A. In some embodiments of the present disclosure, the platform controlling element 103 may comprise a second wireless receiving element 103*a*, a signal processing element 103*b*, and a platform door opening-or-closing element 103*c*. The second wireless receiving element 103*a* may correspond to the signal transmitted by the wireless transmitting element 102*c* and may by any kind of wireless receiver for receiving the platform-vehicle integration signal T3 and transmitting the received platform-vehicle integration signal T3 to the signal processing element 103*b* with wire or wirelessly. In the embodiment, the second wireless receiving element 103 may also comprise a reader for receiving the RF signal from the first wireless receiving element 102*b*.

The signal processing element 103*b* may be a data processor which determines the opening or closing status of the vehicle door 111A of the vehicle 11 currently stops at the platform 12 in accordance with the platform-vehicle integration signal T3 and transmits the platform door opening-or-closing signal T4 to the platform door opening-or-closing element 103*c* with wire or wirelessly to drive the mechanics (not shown) of the platform door 121A to open or close the platform door 121A corresponding to the opening or closing status of the vehicle door 111A.

The vehicle door detecting element 104, positioned on the platform 12, is used to detect the opening or closing status of the corresponding vehicle door 111A of the vehicle 11 currently stopping at the platform 12, and to transmit the vehicle door opening-or-closing signal T5 to the platform controlling element 103 with wire or wirelessly. After a predetermined period of time has passed since the platform data transmitting element 101 transmitted the platform signal T1, and the platform controlling element 103 does not receive the platform-vehicle integration signal T3 which should be transmitted by the vehicle information integrating element 102 through the second wireless receiving element 103*a*, the signal processing element 103*b* of the platform controlling element 103 response to the vehicle door opening-and-closing signal T5 provided by the vehicle door detecting element 104, and the platform door opening-or-closing element 103*c* transmits the platform opening-or-closing signal T4 to drive the mechanics (not shown) of the platform door 121A to open or close the platform door 121A corresponding to the opening or closing of the vehicle door 111A.

In some embodiments of the present disclosure, the vehicle door detecting element 104 may comprise an image detection unit, a sound energy detection unit, a thermal energy detection unit, a radiant energy detection unit or a combination thereof, which is capable of individually detecting the opening-or-closing status of the vehicle door 111A of the vehicle 11 stopping at the platform 12, and the vehicle door opening-or-closing signal T5 comprising the opening or closing status of the vehicle door 111A is transmitted to the platform controlling element 103 with wire or wirelessly. In other words, the vehicle door detecting element 104 can be seen as a backup device. When the wireless communication among the platform data transmitting element 101, the vehicle information integrating element 102 and the platform door controlling element 103 fails, or any one of the platform data transmitting element 101, the vehicle information integrating element 102 and the second wireless receiving element 103*a* malfunctions, the platform door controlling element 103 may still accurately control the opening or closing of the platform door 121A corresponding to the opening or closing status of the vehicle door 111A, in accordance with the vehicle door opening-or-closing signal T5 provided by the vehicle door detecting element 104.

In some embodiments of the present disclosure, when the vehicle door detecting element 104 transmits the vehicle door opening-or-closing signal T5, it is indicated that the vehicle 11 has stopped and the vehicle door 111A is open, or the vehicle door 111A is closed and the vehicle 11 is ready to depart. If the vehicle door detecting element 104 has transmitted the vehicle door opening-or-closing signal T5 for a predetermined time, the platform controlling element 103 is still not yet received the platform-vehicle integration signal T3, it is indicated that the communication among the platform data transmitting element 101, the vehicle information integration element 102, and the platform door controlling element 103 fails, or one of the platform data transmitting element 101, the vehicle information integrating element 102 and the second wireless receiving element 103*a* malfunctions. At this moment, the platform controlling element 103 will open or close the platform door 121 A to correspond to the opening or closing status of the vehicle door 111A, in accordance of the vehicle door opening or closing signal T5 provided by the vehicle door detecting element 104.

In some embodiments of the present disclosure, after the platform data transmitting element 101 has transmitted the platform signal T1 for a predetermined period of time, the platform door controlling element 103 still not yet received the platform-vehicle integration signal T3, the platform door controlling element 103 will open or close the platform door 121A in respond to the opening or closing status of the vehicle door 111A, in accordance with the vehicle door opening-or-closing signal T5 provided by the vehicle door detecting element 104. However, it should be noted that it is not limited to the way described to determine if the (wireless) communication fails. Any technical approach to valid the (wireless) communication ability is applicable to the platform door system 100.

Figure 2A:
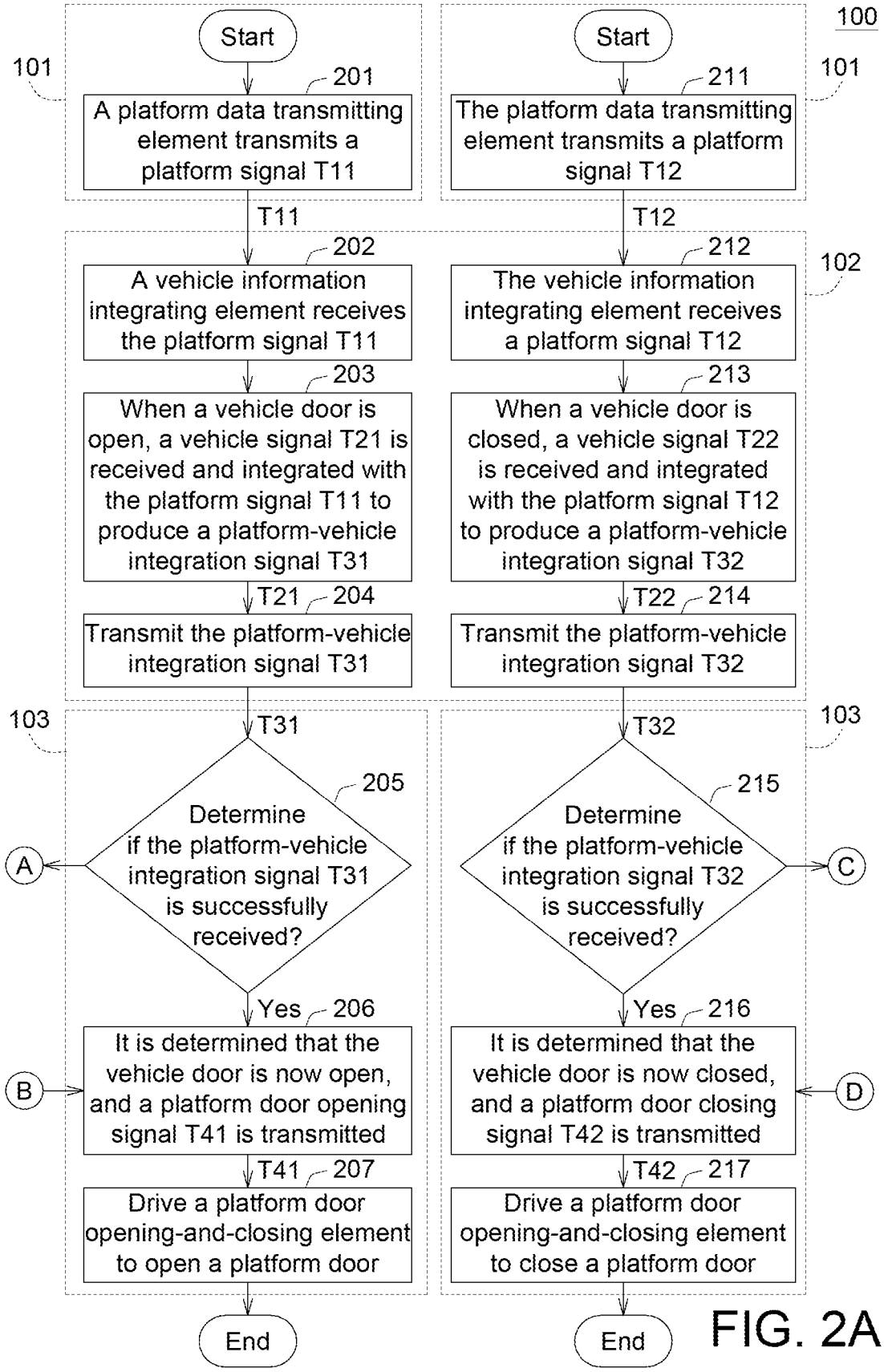
FIG. 2A and FIG. 2B illustrate flow charts of a control method for the platform door system according to one embodiment.
Figure 2B:
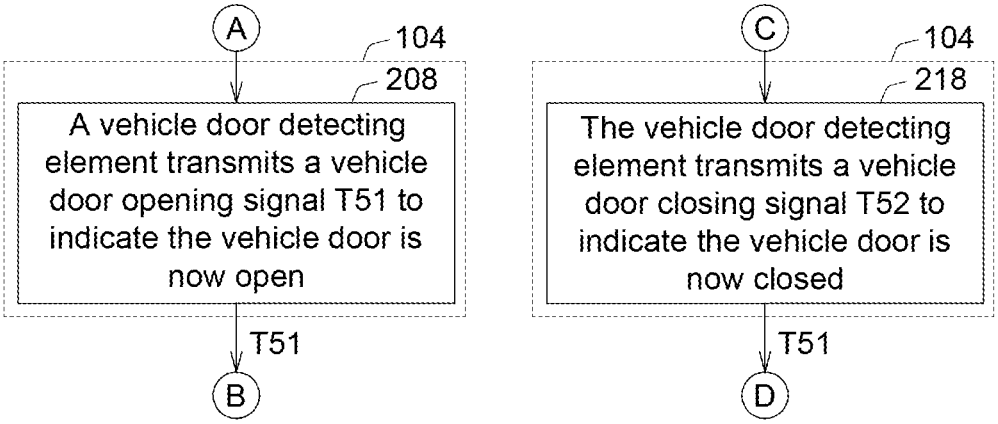

Please refer to FIG. 2A and FIG. 2B. FIG. 2A and FIG. 2B are flow charts illustrating a control method for controlling the platform door system 100 according to one embodiment of the present disclosure, wherein the left side of FIG. 2A and FIG. 2B illustrate the process of opening the platform door 121A, and the right side of FIG. 2A and FIG. 2B illustrate the process of closing the platform door 121A.

The left side of FIG. 2A and FIG. 2B illustrate the process of opening the platform door 121A with the control method for the platform door system 100. The process of opening the platform door 121A comprises the following steps. First, transmitting the platform signal T11 by the platform data transmitting element 101 when the vehicle 11 stops at the platform (step 201). The vehicle information integration element 102 on the vehicle 11 receives the platform signal T11 from the platform data transmitting element 101 through the first wireless receiving element 102*b* (step 202). When the vehicle door 111A of the vehicle 11 is open, the vehicle information integration element 102 receives the vehicle signal T21 provided by the vehicle information providing element 102*a* (to indicate the vehicle door 111A is now open), and integrate the platform door signal T11 and the vehicle signal T21 to produce platform-vehicle integration signal T31 (step 203). Next, the platform-vehicle integration signal T31 is transmitted by the wireless transmitting element 102*c* of the vehicle information integrating element 102 (step 204).

The platform door controlling element 103 on the platform 12 will determine if the platform-vehicle integration signal T31 is successfully received (step 205). When it is determined that the platform controlling element 103 successfully receives the platform-vehicle integration signal T31 through the second wireless receiving element 103*a* (the path "Yes"), the signal processing element 103*b* of the platform door controlling element 103 determines the vehicle door 111A of the vehicle 11 is now open in accordance with the platform-vehicle integration signal T31, and transmits the platform door opening signal T41 to the platform door opening-or-closing element 103*c* (step 206). The platform opening-or-closing element 103*c* of the platform door controlling element 103 will drive the mechanics (not shown) to open the platform door 121A in accordance with the platform door opening signal T41 (step 207). When the platform door controlling element 103 does not successfully receive the platform-vehicle integration signal T31 (the path "No"), the signal processing element 103*b* of the platform door controlling element 103 will, in accordance with the vehicle door opening signal T51 transmitted by the vehicle door detecting element 104 on the platform 12, indicate the vehicle door 111A of the vehicle 11 is now open (step 208) and transmit the platform door opening signal T41 to the platform door opening-or-closing element 103*c*. The platform door opening-or-closing element 103*c* of the platform door controlling element 103 will drive the mechanics to open the platform door 121A in accordance with the vehicle door opening signal T51 (step 207).

The right side of FIG. 2A and FIG. 2B illustrate the process of closing the platform door 121A with the control method for the platform door system 100. The process of closing the platform door 121A comprises the following steps. First, keep transmitting the platform signal T12 by the platform data transmitting element 101 when the vehicle 11 departs from the platform (step 211). The vehicle information integration element 102 on the vehicle 11 receives the platform signal T12 from the platform data transmitting element 101 through the first wireless receiving element 102*b* (step 212). When the vehicle door 111A of the vehicle 11 is closed, the vehicle information integration element 102 receives the vehicle signal T22 provided by the vehicle information providing element 102*a*, and integrate the platform door signal T12 and the vehicle signal T22 to produce platform-vehicle integration signal T32 (step 213). Next, the platform-vehicle integration signal T32 is transmitted by the wireless transmitting element 102*c* of the vehicle information integrating element 102 (step 214).

The platform door controlling element 103 on the platform 12 will determine if the platform-vehicle integration signal T32 is successfully received (step 215). When it is determined that the platform controlling element 103 successfully receives the platform-vehicle integration signal T32 through the second wireless receiving element 103*a* (the path "Yes"), the signal processing element 103*b* of the platform door controlling element 103 determines the vehicle door 111A of the vehicle 11 is now closed in accordance with the platform-vehicle integration signal T32, and transmits the platform door closing signal T42 to the platform door opening-or-closing element 103*c* (step 216). The platform opening-or-closing element 103*c* of the platform door controlling element 103 will drive the mechanics (not shown) to close the platform door 121A in accordance with the platform door closing signal T42 (step 217). When the platform door controlling element 103 does not successfully receive the platform-vehicle integration signal T32 (the path "No"), the signal processing element 103*b* of the platform door controlling element 103 will, in accordance with the vehicle door closing signal T52 transmitted by the vehicle door detecting element 104 on the platform 12, indicate the vehicle door 111A of the vehicle 11 is now closed (step 218) and transmit the platform door closing signal T42 to the platform door opening-or-closing element 103*c*. The platform door opening-or-closing element 103*c* of the platform door controlling element 103 will drive the mechanics to open the platform door 121A in accordance with the vehicle door closing signal T52 (step 217).

In accordance with the above embodiments, a platform door system and a method for controlling the same are disclosed. Through the wireless communication among the platform data transmitting element and the platform door controlling element positioned on the platform and the vehicle information integrating element positioned on the vehicle, information, which comprises if the vehicle stops and the opening or closing status of the vehicle door, and other vehicle relevant data, are exchanged. The platform signal is provided by the platform data transmitting element, and the vehicle information integrating element integrates the vehicle signal corresponding to the opening-or-closing status of the vehicle door from the vehicle and the platform signal from the platform to produce the platform-vehicle integration signal to be transmitted to the platform door controlling element. The platform door controlling element opens or closes the platform door in response to the platform-vehicle integration signal to correspond to the opening or closing status of the vehicle door.

At the same time, the vehicle door detecting element, positioned on the platform, is used to be a backup plan for individually detecting the opening or closing status of the vehicle door and transmitting the detected vehicle door opening-or-closing signal to the platform door controlling element. When the mutual communication between the platform and the vehicle fails, the platform door controlling element still can open or close the platform door, in accordance with the vehicle door opening-or-closing signal transmitted by the vehicle door detecting element, even if the platform door controlling element does not receive the platform-vehicle integration signal.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A platform door system, comprising:

a platform data transmitting element, positioned on a platform for transmitting a platform signal;

a vehicle information integrating element, positioned on a vehicle adjacent to the platform for receiving the platform signal and a vehicle signal from the vehicle, and for transmitting a platform-vehicle integration signal in accordance with the platform signal and the vehicle signal, wherein the vehicle signal corresponds to an opening-or-closing status of a vehicle door of the vehicle;

a platform door controlling element, positioned on the platform for receiving the platform-vehicle integration signal, and for opening or closing a platform door in response to the platform-vehicle integration signal to correspond to the opening-or-closing status of the vehicle door; and a vehicle door detecting element, positioned on the platform for detecting the opening-or-closing status of the vehicle door and transmitting a vehicle door opening-or-closing signal, wherein when being not capable of receiving the platform-vehicle integration signal, the platform door controlling element open or close the platform door in response to the vehicle door opening-or-closing signal.

2. The platform door system according to claim 1 wherein the vehicle door detecting element comprises an image detection unit, a sound energy detection unit, a thermal energy detection unit, or a radiant energy detection unit for detecting the opening-or-closing status of the vehicle door.

3. The platform door system according to claim 1, wherein the platform data transmitting element comprises a radio frequency transmitting unit which has an ID code of the platform.

4. The platform door system according to claim 3, wherein the platform data transmitting element is a radio frequency identification (RFID) tag.

5. The platform door system according to claim 1, wherein the vehicle information integrating element is a control logic built in an operation system of the vehicle.

6. The platform door system according to claim 1, wherein the vehicle information system further comprises:

a vehicle information providing element for providing the vehicle signal;

a first wireless receiving element for receiving the platform signal; and a wireless transmitting element for transmitting the platform-vehicle integration signal.

7. The platform door system according to claim 6, wherein the vehicle information providing element comprises a vehicle door opening/closing detector.

8. The platform door system according to claim 1, wherein the platform door controlling element further comprises:

a second wireless receiving element for receiving the platform-vehicle integration signal;

a signal processing element for determining the opening-or-closing status of the vehicle door; and a platform door opening-or-closing element for opening or closing the platform door.

9. A control method for a platform door system, the control method comprising:

providing a platform data transmitting element on a platform for transmitting a platform signal;

providing a vehicle information integrating element on a vehicle adjacent to the platform for receiving the platform signal and a vehicle signal from the vehicle, and for transmitting a platform-vehicle integration signal in accordance with the platform signal and the vehicle signal, wherein the vehicle signal corresponds to an opening-or-closing status of a vehicle door of the vehicle;

providing a platform door controlling element on the platform for receiving the platform-vehicle integration signal, and for opening or closing a platform door in response to the platform-vehicle integration signal to correspond to the opening-or-closing status of the vehicle door; and providing a vehicle door detecting element on the platform for detecting the opening-or-closing status of the vehicle door and transmitting a vehicle door opening-or-closing signal, wherein when being not capable of receiving the platform-vehicle integration signal, the platform door controlling element open or close the platform door in response to the vehicle door opening-or-closing signal.

10. The control method according to claim 9, wherein the platform door controlling element open or close the platform door in response to the vehicle door opening-or-closing signal after the platform data transmitting element has transmitted the platform signal for a predetermined period of time and the platform-vehicle integration signal is not received.

11. The control method according to claim 9, wherein the platform door controlling element open or close the platform door in response to the vehicle door opening-or-closing signal after the vehicle door detecting element has transmitted the vehicle door opening-or-closing signal for a predetermined period of time and the platform-vehicle integration signal is not received.

* * * * *